United States Patent [19]

Börner et al.

[11] Patent Number: 4,514,935

[45] Date of Patent: May 7, 1985

[54] SCANNING DEVICE FOR A MACHINE FOR THE AUTOMATIC SHARPENING OF BROACHING OR REAMING TOOLS

[76] Inventors: Roland Börner, Schellberger Weg 43; Herbert Holstein, Felder Strasse 65, both of D-5650 Solingen 1, Fed. Rep. of Germany

[21] Appl. No.: 399,885

[22] Filed: Jul. 16, 1982

[30] Foreign Application Priority Data

Aug. 8, 1981 [DE] Fed. Rep. of Germany ..... 3131511

[51] Int. Cl.[3] ..... B24B 49/00

[52] U.S. Cl. ..... 51/165 R; 51/34 C; 51/216 ND; 51/92 ND

[58] Field of Search ..... 51/165 R, 165.77, 165.71, 51/92 ND, 216 ND, 288, 34 C

[56] References Cited

U.S. PATENT DOCUMENTS

| | | | |
|---|---|---|---|
| 3,616,578 | 11/1971 | Clark | 51/165 R |
| 3,646,593 | 2/1972 | Schubert | 51/165 R |
| 4,348,838 | 9/1982 | Tacchella | 51/165 R |

FOREIGN PATENT DOCUMENTS 2926807 1/1981 Fed. Rep. of Germany .

*Primary Examiner*—Harold D. Whitehead

[57] ABSTRACT

A scanning device for a machine for the automatic sharpening of broaching or reaming tools has a horizontal slide for receiving a tool to be sharpened and a vertical slide having at least one grinding spindle. A scanning finger which can be moved approximately vertically relative to the scanning device is provided for ascertaining the position of a particular tooth and is coupled with at least one member which emits displacement-dependent signals for triggering drive mechanisms for the machine slides. In order to enable a substantially arbitrary, yet precise, guidance of the scanning finger in order to ascertain dimensions which are of importance for the geometry of the tool, the scanning finger is attached on one of two slides which are displaceable at right angles relative to one another and a displacement pickup is associated with each slide for detecting the displacement distance from a position of rest traveled by respective slide.

8 Claims, 6 Drawing Figures

SCANNING DEVICE FOR A MACHINE FOR THE AUTOMATIC SHARPENING OF BROACHING OR REAMING TOOLS

FIELD OF THE INVENTION

The invention relates to a scanning device for a machine for the automatic sharpening of broaching or reaming tools. The device has a horizontal slide for receiving a tool to be ground as well as a vertical slide provided with at least one grinding spindle. A scanning finger which is movable approximately vertically with respect to the scanning device is provided for detecting the position of a given reaming tooth of the tool being ground and is coupled with at least one member which emits diplacement-dependent signals for triggering drive mechanisms for the machine slides.

BACKGROUND OF THE INVENTION

Machines for the automatic sharpening of broaching or reaming tools of the general type described above, having a scanning device and a scanning finger, are known from U.S. Pat. No. 3,646,593 and are also available on the market. In these known machines, when there is an appropriate movement of the horizontal slide the scanning finger drops via the cutting edge of the reaming tooth of a reaming or broaching tool which is to be ground, and the horizontal slide is thus arrested. A radial advancement of the vertical slide having the grinding slide then occurs as well, in accordance with the vertical deflection of the scanning finger, which is resting with its horizontal scanning face on the free face of the reaming tooth. When the grinding slide having a grinding spindle is radially advanced in this manner, the scanning finger is raised from its scanning position in contact with the tooth, and the grinding disc is guided a plurality of times over the face to be ground, in accordance with an appropriately predetermined positioning. Then the next tooth is ground. Because wear marks are often found on the worn cutting edge of a reaming tooth, that is, the edge which is now to be ground, and these marks cause errors in ascertaining the actual position of the cutting edge on the part of the scanning finger, an undercut is provided in front of the flat scanning face, so that the horizontal scanning face or rather its forward edge, defined by the undercut, rests on the free face of the tooth spaced apart from the cutting edge by a distance such that there are no further wear marks or the like. The face of the undercut along which the scanning finger drops downward via the worn cutting edge extends vertically. Machines of this general type for the automatic sharpening of broaching or reaming tools have become widely established and have proved themselves in practice.

However, it has been found in practice that very frequently, wear marks which cause errors in ascertaining the set-point position of the cutting edge also exist on the chip face in the vicinity of the cutting edge. A further particularly important point is that naturally the worn edge is not a sharply defined edge any longer, but rather an arc-like, curved face, so that errors in scanning occur. For this reason, it is efficacious to scan not only the free face but also the chip face, at a predetermined distance from the location of the original, unworn cutting edge.

With respect to the above problem, it has become known from German laid-open application No. DE-OS 29 26 807 to use two scanning fingers, one of which scans the free face while the other scans the chip face. This embodiment may be satisfactory in functional terms; however, because two scanning fingers have to be provided, it is expensive to build and also correspondingly more delicate.

SUMMARY OF THE INVENTION

It is accordingly the object of the present invention to embody a scanning device of the general type discussed above in such a manner as to enable a substantially arbitrary yet precise guidance of the scanning finger for ascertaining dimensions which are of critical importance in the geometry of the broaching or reaming tool.

This object is attained in accordance with the invention by disposing the scanning finger on one of two slides which are vertically displaceable relative to one another and by providing a displacement pickup for each slide which ascertains the distance traveled by each slide beginning at a state of rest.

As a result of the provisions according to the invention, the scanning finger is precisely displaceable at rectangular coordinates, and the movement of the scanning finger in every coordinate direction is ascertained precisely, so that scanning of the original position of the cutting edge is possible by means of scanning the free face and the chip face of the reaming tooth to be ground at a given time, at a distance from the cutting edge. This is described in a companion U.S. patent application Ser. No. 399,884, entitled "Scanning Finger for a Scanning Device of a Machine for the Automatic Sharpening of Broaching or Reaming Tools" owned by the present assignee and filed on the same date as this application; the entire disclosure of which is hereby incorporated by reference as if here set forth in full. However, it is also possible to scan the bottom of the chip chamber and the associated area of the chip face, as a result of which again the geometry of the reaming tooth being ground at a given time, and thus the set-point position of its cutting edge, is ascertained.

The invention further provides structural features by means of which it is assured that the vertical slide and the horizontal slide, one of which carries the scanning finger, are displaceable out of their respective positions of rest in an easily movable manner yet without play.

Since the embodiment according to the invention makes it possible for the scanning finger to scan the position of the chip face and/or of the bottom of the chip chamber below and behind the cutting edge, it is advantageous for a pivotable lever to engage one of the slides in the displacement direction for both slides.

Further advantages and characteristics of the invention will become apparent from the ensuing detailed description of a preferred embodiment taken in conjunction with the drawings.

DESCRIPTION OF THE PREFERRED EMBODIMENT

Figure 1:
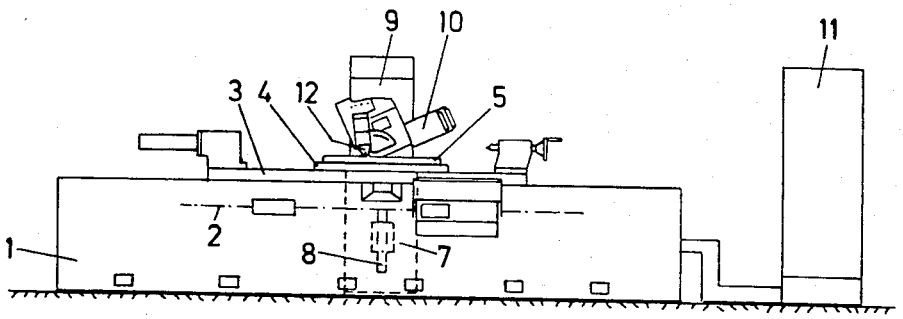
FIG. 1 is a schematic side view of a machine for the automatic sharpening of broaching or reaming tools.
Figure 2:
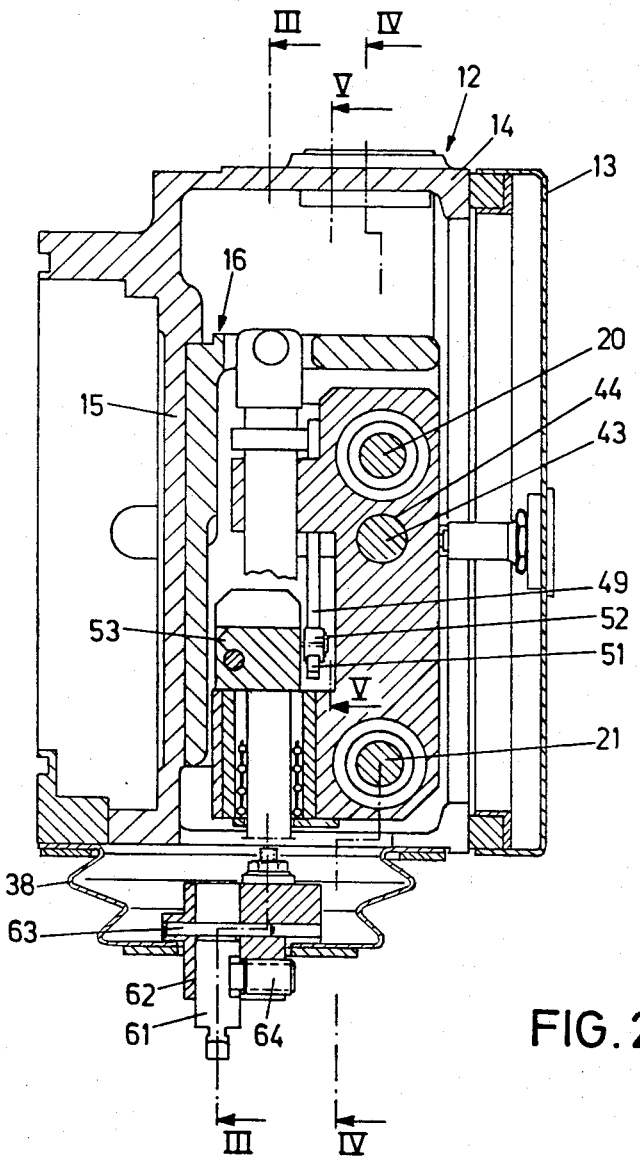
FIG. 2 is a cross section taken through a scanning device along the line II—II of FIG. 4.
Figure 3:
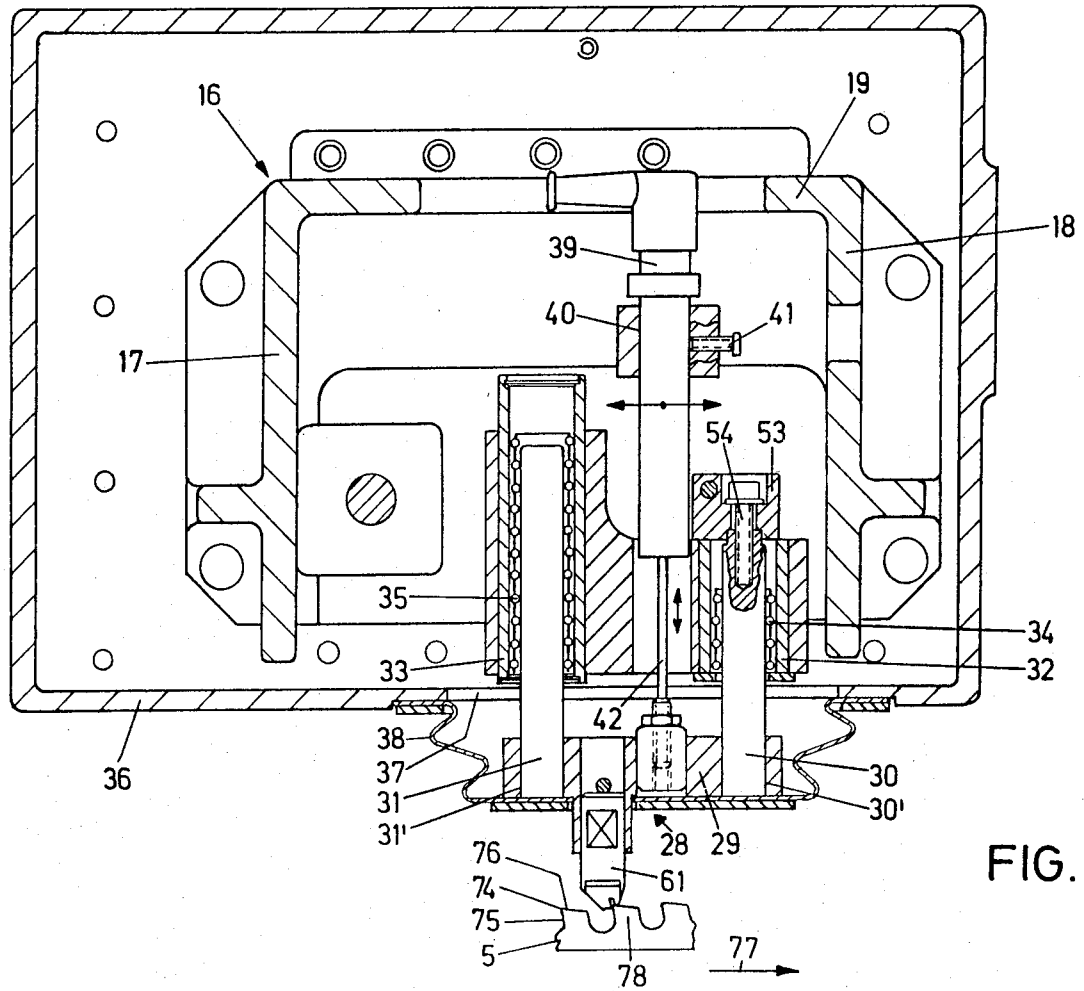
FIG. 3 is a section taken through the scanning device along the line III—III of FIG. 2.

As may be seen in FIG. 1, an automatic sharpening machine for broaching or reaming tools has a horizontal slide 3, which is guided on a machine bed 1 and is driven via a rolling spindle 2 by a servomotor disposed in the machine bed 1 but not visible in the drawing. The horizontal slide 3 carries a broaching or reaming tool 5, which is to be sharpened, on a magnetic clamping plate 4. The broaching tool sharpening machine further has a vertical slide 7 connected to the machine bed 1 and likewise driven via a rolling spindle 8 by a servomotor which is again not visible in the drawing. On its upper end, the vertical slide 7 carries a grinding slide 9, which is rotatably supported and has one or more grinding spindles 10. The grinding slide 9 is capable of reciprocating movement on the vertical slide 7, transversely to the horizontal slide 3 and thus perpendicular to the plane of the drawing in FIG. 1.

Switchboards or control panels 11 are also provided, which accommodate preprogrammable control devices for triggering the individual drive motors.

Disposed on the front part of the grinding spindle 10 is a scanning device 12, by means of which the geometry of the tool 5 to be ground is ascertained such that precise sharpening is possible. This previously described broaching tool sharpening machine is known in principle, for instance from U.S. Pat. No. 3,646,593, and is also available on the market.

The scanning device 12 has an approximately squared housing 14, which is closable by means of a lid 13 and secured on a base plate (not shown) on the grinding spindle 10. The housing may be secured on this base plate in such a manner that it is possible to perform adjustment of the housing 14 by means of micrometer screws, as described in U.S. Pat. No. 3,646,593.

A support frame 16 is screwed onto the bottom 15 of the housing 14, the bottom 15 being oriented toward the grinding spindle 10 and facing the lid 13. The support frame 16 has two vertical holder struts 17, 18 disposed spaced apart from one another and one upper, horizontal holder strut 19 connecting the two vertical struts.

Two guide rods 20, 21 are held in a common vertical plane, spaced apart from one another, in the two vertical holder struts 17, 18 and are fixed by gluing or the like so that they are axially immovable in appropriately shaped bores 22 in the holder struts 17, 18. A horizontal slide 23 is displaceably supported on these two horizontal guide rods 20, 21 and surroundingly engages the horizontal guide rods 20, 21 by means of guide sleeves 24, 25. Ball cages 26, 27 are respectively disposed between the guide rod 20 or 21 on the one hand and the guide sleeve 24 or 25 on the other, so as to assure easily movable guidance and horizontal displaceability of the horizontal slide 23 relative to the housing 14 of the scanning device 12 yet without there being any play.

A vertical slide 28 is supported in a vertically displaceable manner in the horizontal slide 23. To this end, two vertical guide columns 30, 31 are attached to a holder carrier 29 disposed horizontally below the horizontal slide 23. The guide columns 30, 31 are secured by gluing in corresponding bores 30′, 31′ in the holder carrier 29. These guide columns 30, 31 are supported in a vertically displaceable manner in corresponding vertical guide sleeves 32, 33 of the horizontal slide 23. Here, again, ball cages 34, 35 are provided between the guide sleeve 32 or 33 on the one hand and the guide column 30 or 31 on the other, so as to assure an easily movable and simultaneously playfree guidance and displaceability of the vertical slide 28 relative to the horizontal slide 23.

The holder carrier 29 of the vertical slide 28 is disposed below the lower side wall 36 of the housing 14, a recess 37 being provided in this side wall 36 for this purpose. A dust-tight closure of this recess 37 is attained by means of a folding bellows 38, which is secured at one end to the holder carrier 29 and at the other to the lower side wall 36. An inductive displacement pickup 39 is secured to the horizontal slide 23, being radially and axially fixed and secured from twisting in a corresponding bore 40 by means of a clamping screw 41. A rod-like adjusting member 42 of the displacement pickup 39 protrudes from the pickup 39 at the bottom and is firmly screwed to the holder carrier 29 of the vertical slide 28. Since the displacement pickup 39 is disposed with its adjusting member 42 parallel to the guide columns 30, 31, vertical displacements of the vertical slide 28 are converted into equal-sized movements on the part of the adjusting member 42 of the displacement pickup 39 and thus into corresponding electrical signals.

A further horizontally disposed inductive displacement pickup 43 is fixed at one end by gluing in a corresponding bore 44 of the horizontal slide 23. On the other end, its rod-like adjusting member 45 is screwed firmly to one vertical holder member 18. Since this displacement pickup 43 is likewise disposed with its adjusting member 45, which is displaceable relative to the pickup 43, parallel to the horizontal guide rods 20, 21, horizontal displacements of the horizontal slide 23 are converted into equal-sized displacement movements of the adjusting member relative to the displacement pickup 43 and thus into corresponding electrical signals.

Figure 4:
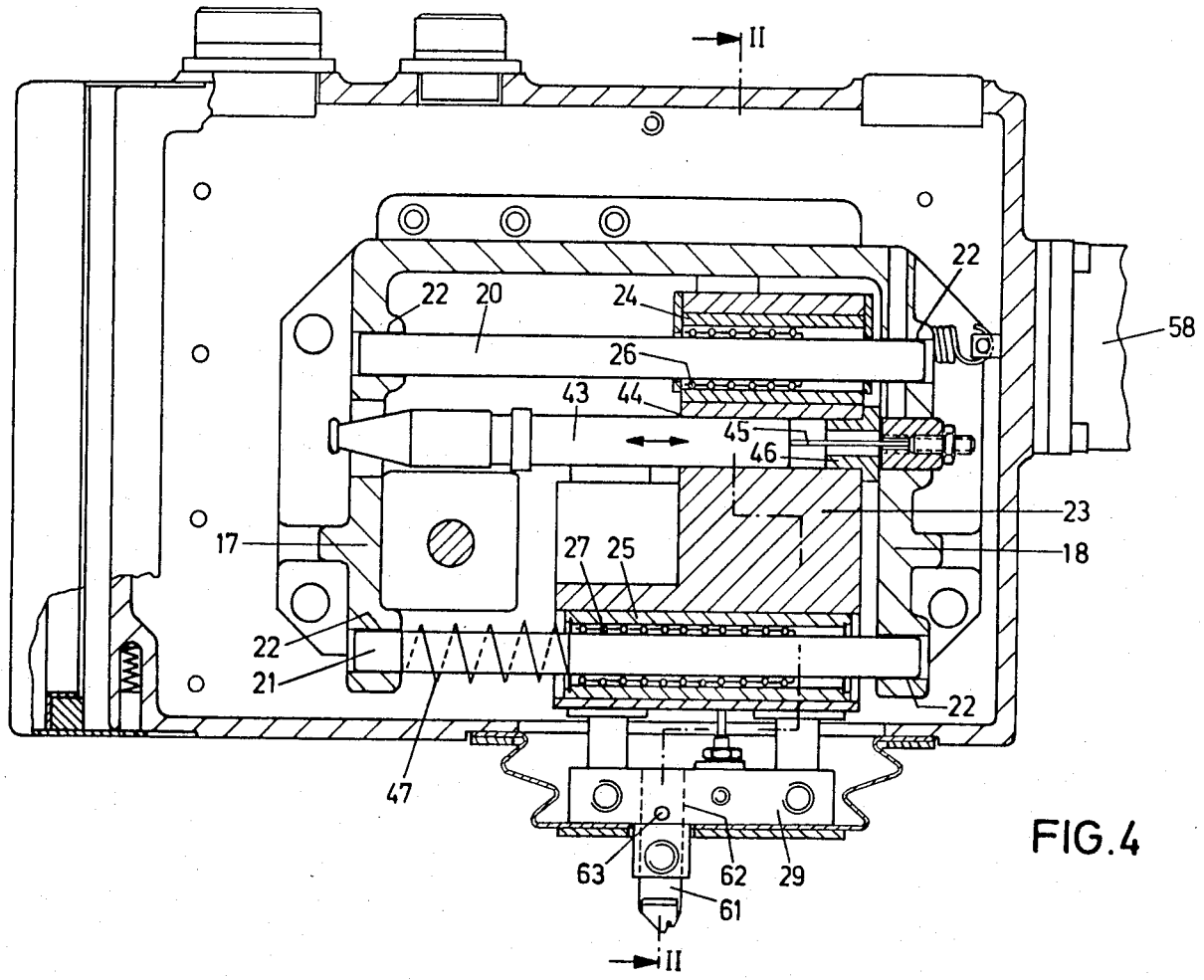
FIG. 4 is a section taken through the scanning device along the line IV—IV of FIG. 2.

A stop sleeve 46 is secured by gluing in the bore 44, coming to rest against the vertical holder strut 18 in which the adjusting member 45 of the horizontal displacement pickup 43 is secured. In this contact position, the horizontal slide 23 is pressed by a prestressed spring 47 into its position of rest. The spring 47 is disposed on a guide rod 21 and on one end rests against the other holder strut 17 and on the other rests on the side of the horizontal slide 23 facing this holder strut 17, see FIG. 4.

The lower position of rest of the vertical slide 28 is reestablished continuously by reason of its own weight.

Figure 5:
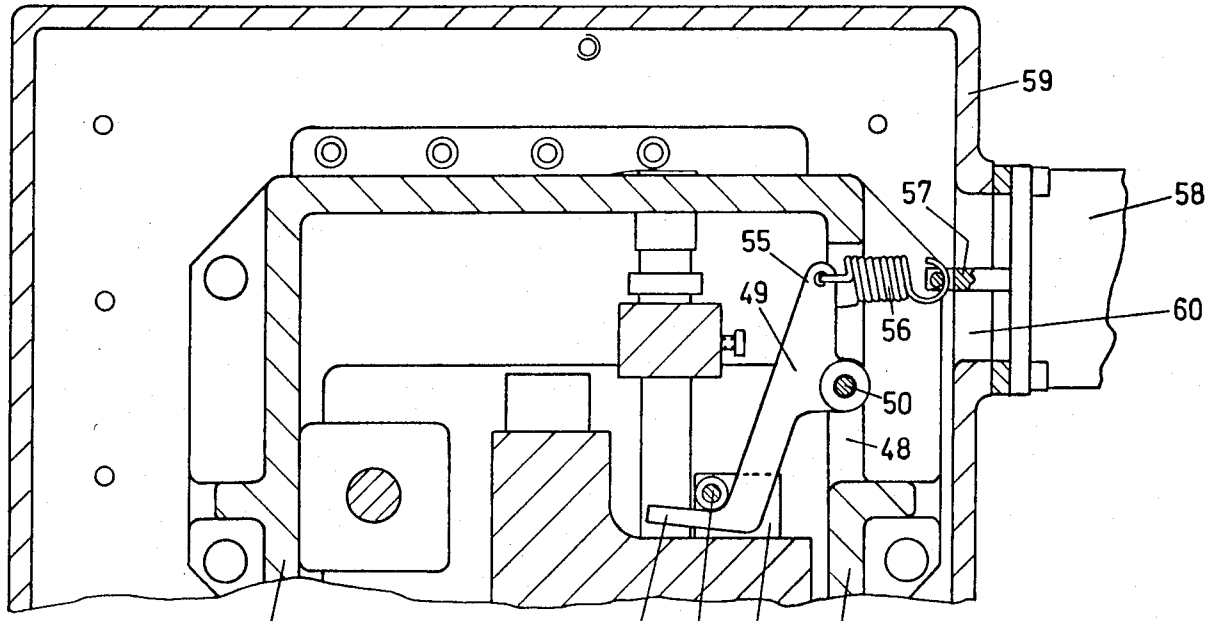
FIG. 5 is a section taken through the scanning device along the line V—V of FIG. 2.
Figure 6:
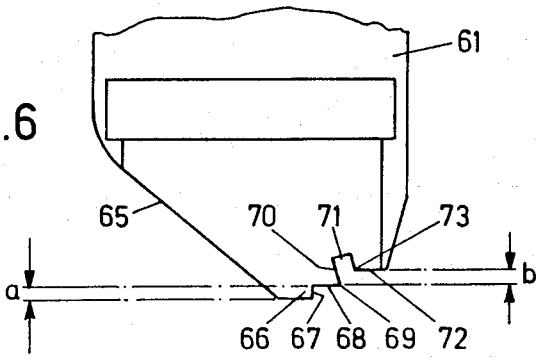
FIG. 6, on a greatly enlarged scale, shows the lower part of a scanning finger which comes to rest on a broaching or reaming tool in the course of its operation.

A lever 49 is pivotably supported about a shaft 50 in a recess 48 in one vertical holder strut 18. The lever 49 is disposed in the plane which is defined by the displacement directions of the horizontal slide 23 and the vertical slide 28; the shaft 50 is thus disposed such that it is normal thereto, see FIG. 5.

The lever 49 has an arm 51 located below and bent away from the shaft 50, this arm 51 engaging the bottom of a tang 52 secured on the vertical slide 28. This tang 52 is attached to a stop element 53, which at its end is threaded by means of a screw 54 against one guide column 31, as a result of which the vertical slide 28 is simultaneously secured against falling downward out of the horizontal slide 23.

A core 57 of a lifting magnet 58 engages one arm 55 which terminates above the shaft 50, and a spring 56 is disposed between the core 57 and the arm 55. The magnet 58 is secured to the associated vertical side wall 59, and the core 57 passes through an opening 60 through this side wall 59. When the electromagnetic lifting magnet 58 is excited, the lever 49 is pivoted such that the vertical slide 28 is raised.

A scanning finger 61 is secured on the holder carrier 29 of the vertical slide 28; it is disposed in an appropriately adapted recess 62 of the holder carrier 29 and fixed at the top by means of a setpin 63 which passes transversely through it. An axial, radial and tangential fixation is attained by means of a grub screw 64.

At its lower end, the scanning finger 61 has an inclined leading face 65, which is adjoined by a nose-like protrusion 66 serving as a preliminary signal transducer. This protrusion 66 is limited by a vertical face 67, which takes a perpendicular, upward course and is adjoined by a horizontal abutment face 68. On the end of the abutment face, there is a measuring edge 69, which is formed by the abutment face 68 and an undercut face 70 which tilts backward and upward. This undercut face 70 defines an undercut 71, which is adjoined by a horizontal scanning face 72.

The horizontal scanning face 72, in turn has an edge 73 which is oriented toward the undercut 71.

The abutment face 68 is located higher by the dimension a than the protrusion 66. The horizontal scanning face 72 is higher again by the dimension b than the abutment face 68. The two dimensions are within the range from a few tenths of a millimeter to one millimeter. The horizontal length of the undercut 71 again amounts to from a few tenths to one millimeter. The structure and mode of operation of the scanning finger are described in detail in the patent application filed on the same date by the present applicant under the title "Scanning Finger for a Scanning Device of a Machine for the Automatic Sharpening of Broaching or Reaming Tools", identified above.

When a broaching or reaming tool 5, the worn cutting edges 74 of which are to be resharpened by grinding the chip face 75 and/ or the free face 76, is moved in the direction 77 by a corresponding drive of the horizontal slide 3, then the scanning finger 61 travels along the free face 76 and with its protrusion 66 drops along the cutting edge 74. By means of this movement, a signal is triggered in the vertical displacement pickup 39, by means of which the drive motor of the horizontal slide 3 is switched over from fast speed to crawling speed.

Upon the continued movement of the horizontal slide 3 in the direction 77, the scanning finger 61 drops lower still when the undercut face 70 reaches the cutting edge 74. The scanning face 72 or its edge 73 thereupon comes to rest on the free face 76. As a result of this renewed signal of the vertical displacement pickup, the drive motor of the horizontal slide is first stopped and then reversed, so that the horizontal slide 3 is now moved opposite to the direction 77, until the measuring edge 69 of the scanning finger 61 comes to rest against the chip face 75 below the cutting edge 74. The horizontal slide 23 is thereupon displaced horizontally counter to the spring 47, as a result of which the displacement pickup 43 simultaneously emits a signal by means of which the horizontal slide 3 is arrested for good. A positioning of the vertical slide 7 is triggered via the displacement pickup 39, until the displacement pickup is again in balance. Further sequential operations are then triggered. These operations include, first, the excitation of the lifting magnet 58, the core 57 of which is retracted inside the lifting magnet, as a result of which the lever 49 is pivoted about the shaft 50 and displaces the vertical slide 28 on the one hand but also the horizontal slide 23 on the other out of their positions of rest, so that the scanning finger 61 is lifted away from the free face 76 and the chip face 75 without performing grinding and is then free from the associated reaming tooth 78. The actual grinding operations are triggered thereby as well.

It is to be understood that the foregoing text and drawings relate to an embodiment of the invention given by way of example but not limitation. Various other embodiments and variants are possible within the spirit and scope of the invention.

What is claimed is:

1. A scanning device for a machine for the automatic sharpening of broaching or reaming tools, including a driven horizontal slide for receiving a tool which is to be sharpened and a driven vertical slide provided with at least one grinding spindle mounted on a grinding slide, said scanning device comprising:

means for mounting said scanning device on said grinding slide;

means, including a scanning finger movable relative to the scanning device, for detecting the position of a given tooth of the tool being ground, said detecting means further including two sliding members displaceable at right angles to one another in a substantially vertical plane, means for mounting said scanning finger upon one of said sliding members, and displacement pickup means associated with each sliding member for detecting the displacement pickup distance travelled by the respective sliding member beginning at its position of rest, said displacement pickup means emitting displacement-dependent signals for triggering drive mechanisms for the machine slides.

2. A scanning device as defined by claim 1, wherein the scanning finger is attached to said sliding member such that it is vertically displaceable with respect to said other sliding member and the other sliding member is supported such that it is horizontally displaceable on guide means which are stationary relative to the scanning device.

3. A scanning device as defined by claim 2, wherein said sliding members comprise vertical and horizontal sliding members which are supported by guide column means and corresponding guide sleeve means on said device receiving the guide column means.

4. A scanning device as defined by claim 3, wherein bearing means are respectively provided in the guide sleeve means.

5. A scanning device as defined by one of the claims 1–4, wherein a lifting device is provided for raising the scanning finger, and means to connect said lifting device to a pivotable lever which engages said sliding member.

6. A scanning device as defined by claim 5, wherein said lifting device comprises an electro-magnet.

7. A scanning device for a machine for the automatic sharpening of broaching or reaming tools, including a driven horizontal slide for receiving a tool which is to be sharpened and a driven vertical slide provided with at least one grinding spindle mounted on a grinding slide, said scanning device comprising:

means for mounting said scanning device on said grinding slide, means, including a scanning finger movable relative to the scanning device, for detecting the position of a given tooth of the tool being ground, said detecting means including two sliding members displaceable at right angles to one another in substantially the same plane, means for mounting said scanning finger upon one of said sliding members, and displacement pickup means associated with each sliding member for detecting the displacement pickup distance travelled by the respective sliding member beginning at its position of rest, said displacement pickup means emitting displacement-dependent signals for triggering drive mechanisms for the machine slides.

8. The scanning device of claim 7, and further including means for attaching one of said two sliding members to said grinding slide, wherein one of said sliding members is housed within the other of said sliding members.

* * * * *

UNITED STATES PATENT AND TRADEMARK OFFICE

CERTIFICATE OF CORRECTION

PATENT NO. : 4,514,935

DATED : May 7, 1985

INVENTOR(S) : Börner et al

It is certified that error appears in the above-identified patent and that said Letters Patent is hereby corrected as shown below:

On the thele page Add:

Add the following in the identification section of the patent:

[73] Assignee: Oswald Forst Maschinenfabrik und Apparatebauanstalt GmbH & Co. KG, Solingen, Federal Republic of Germany.

Signed and Sealed this

*Fifth* Day of *November 1985*

[SEAL]

*Attest:*

*Attesting Officer*

DONALD J. QUIGG

*Commissioner of Patents and Trademarks*